US011809113B2

(12) United States Patent
Kyotani et al.

(10) Patent No.: US 11,809,113 B2
(45) Date of Patent: Nov. 7, 2023

(54) DRUM CARTRIDGE FOR USE WITH A TONER CARTRIDGE IN AN IMAGE FORMING APPARATUS

(71) Applicant: Brother Kogyo Kabushiki Kaisha, Nagoya (JP)

(72) Inventors: Tadao Kyotani, Nagoya (JP); Chieko Mimura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/355,551

(22) Filed: Jun. 23, 2021

(65) Prior Publication Data

US 2021/0318649 A1 Oct. 14, 2021

Related U.S. Application Data

(63) Continuation of application No. 17/010,954, filed on Sep. 3, 2020, now Pat. No. 11,092,920.

(30) Foreign Application Priority Data

Sep. 30, 2019 (JP) ..... 2019-178770
Sep. 30, 2019 (JP) ..... 2019-178771
Sep. 30, 2019 (JP) ..... 2019-178772

(51) Int. Cl.
*G03G 15/00* (2006.01)
*G03G 15/02* (2006.01)
(Continued)

(52) U.S. Cl.
CPC ..... *G03G 15/5012* (2013.01); *G03G 15/0266* (2013.01); *G03G 15/5016* (2013.01);
(Continued)

(58) Field of Classification Search
CPC ..... G03G 15/5012; G03G 15/0266
See application file for complete search history.

(56) References Cited

U.S. PATENT DOCUMENTS 4,961,088 A * 10/1990 Gilliland ..... G03G 21/02 399/25
6,173,128 B1 1/2001 Saber et al.
(Continued)

FOREIGN PATENT DOCUMENTS

JP 2001-096845 A 4/2001
JP 2001312185 A * 11/2001
(Continued)

OTHER PUBLICATIONS

JP_2001312185_A_I MachineTranslation, Japan, Nakada, 2001.*
(Continued)

*Primary Examiner* — Victor Verbitsky
(74) *Attorney, Agent, or Firm* — BURR PATENT LAW, PLLC

(57) ABSTRACT

An image forming apparatus includes a drum cartridge and a controller. The drum cartridge includes a photosensitive drum, a charger and a drum cartridge memory storing a life count value and discharge history information. The controller includes a voltage applying circuit, and an abnormal discharge detection circuit. In a case where the abnormal discharge detection circuit detects an abnormal discharge, the controller does not permit printing in a case where the life count value is equal to or more than a first reference value and a number of abnormal discharges which is included in the discharge history information read from the drum cartridge memory is equal to or more than a particular threshold value, or permits printing in a case where the life
(Continued)

count value is equal to or more than the first reference value and the number of abnormal discharges is less than the particular threshold value.

13 Claims, 11 Drawing Sheets

(51) Int. Cl.
*G03G 21/20* (2006.01)
*G03G 21/16* (2006.01)

(52) U.S. Cl.
CPC ..... *G03G 15/55* (2013.01); *G03G 21/1633* (2013.01); *G03G 21/206* (2013.01)

(56) References Cited

U.S. PATENT DOCUMENTS

| | | | | |
|---|---|---|---|---|
| 2006/0034627 | A1 | 2/2006 | Kikuchi et al. | |
| 2009/0060535 | A1* | 3/2009 | Hamaya ..... | G03G 21/06 399/34 |

FOREIGN PATENT DOCUMENTS

| | | | | |
|---|---|---|---|---|
| JP | 2006-030929 | A | | 2/2006 |
| JP | 2006126606 | A | * | 5/2006 |
| JP | 2008152162 | A | * | 7/2008 |
| JP | 2009-053422 | A | | 3/2009 |
| JP | 2013-050601 | A | | 3/2013 |
| JP | 2013-250335 | A | | 12/2013 |
| JP | 2019-012233 | A | | 1/2019 |

OTHER PUBLICATIONS

JP_2008152162_A_I MachineTranslation, Japan, Abe, 2009.*
JP_2006126606_A_T MachineTranslation, Japan, Yamamoto, 2006.*
JP_2008152162_A_I MachineTranslation, Japan, Abe, 2008.*
Japanese Office Action (Application No. 2019-178771) dated Aug. 1, 2023 (with English translation) (8 pages).
Japanese Office Action (with English translation) dated Aug. 8, 2023 (Application No. 2019-178772).

* cited by examiner

DRUM CARTRIDGE FOR USE WITH A TONER CARTRIDGE IN AN IMAGE FORMING APPARATUS

CROSS-REFERENCE TO RELATED APPLICATION

This application is a Continuation Application of U.S. patent application Ser. No. 17/010,954, filed Sep. 3, 2020 and claims priority under 35 U.S.C. § 119 from Japanese Patent Application No. 2019-178770, Japanese Patent Application No. 2019-178771 and Japanese Patent Application No. 2019-178772, all filed on Sep. 30, 2019, the entireties of which are incorporated herein by reference.

BACKGROUND

Technical Field

Aspects of the present disclosures relate to image forming apparatuses.

Related Art

An electrophotographic image forming apparatus such as an LED printer is conventionally known. This type of image forming apparatus includes a casing and a drum cartridge attachable to and detachable from the casing. A conventional image forming apparatus includes a controller in the casing. The controller has a drum rotation counter and a life determination unit. The drum rotation counter counts a number of rotations of a photosensitive drum. The life determination unit determines that the photosensitive drum reached the end of life in a case where the number of rotations of the photosensitive drum counted by the drum rotation counter reached a value corresponding to the end of life of the photosensitive drum. In the conventional image forming apparatus, as described above, the life of the drum cartridge (photosensitive drum) is monitored by the controller of the casing.

In another conventional image forming apparatus, a drum cartridge (a photosensitive member cartridge) also includes one or more chargers. The charger is, for example, a scorotron charger and includes charging wire and a metal grid. The charger also includes a wire cleaner. The wire cleaner is slidable along the charging wire. Dirt on the charging wire can be removed as a user reciprocally moves the wire cleaner along the charging wire. In the another conventional image forming apparatus, in a case an abnormal discharge is detected during printing, occurrence of the abnormal discharge is notified to the user and the user is prompted to perform cleaning of the charging wire.

SUMMARY

However, in the former one of the above-described conventional image forming apparatuses, occurrence of abnormal discharge of the charger is not considered. Therefore, in a case where a drum cartridge in which the abnormal discharge occurred in an image forming apparatus is attached to another image forming apparatus, the drum cartridge cannot be appropriately monitored.

Also, in the latter one of the above-described conventional image forming apparatuses, when a drum cartridge that was mounted and used in the casing of the image forming apparatus is mounted to the casing of another image forming apparatus, the controller cannot determine whether the abnormal discharge has ever occurred or is occurring in the drum cartridge, or whether the abnormal discharge state can be released.

According to aspects of the present disclosures, there is provided an image forming apparatus including a drum cartridge and a controller. The drum cartridge includes a photosensitive drum, a charger configured to charge an outer periphery of the photosensitive drum, and a drum cartridge memory storing a life count value being a value relating to life of the drum cartridge and discharge history information being information relating to one or more abnormal discharges of the charger occurred in the past. The controller includes a voltage applying circuit configured to apply voltage to the charger, and an abnormal discharge detection circuit configured to detect the abnormal discharge based on a current value of current flowing through the voltage applying circuit. In a case where the abnormal discharge detection circuit detects the abnormal discharge, the controller is configured to not permit printing in a case where the life count value read from the drum cartridge memory is equal to or more than a first reference value and a number of abnormal discharges which is included in the discharge history information read from the drum cartridge memory is equal to or more than a particular threshold value, or to permit printing in a case where the life count value read from the drum cartridge memory is equal to or more than the first reference value but the number of abnormal discharges which is included in the discharge history information read from the drum cartridge memory is less than the particular threshold value.

According to aspects of the present disclosures, there is further provided an image forming apparatus including a casing, a drum cartridge, a controller, and a main memory. The drum cartridge is mountable on the casing. The main memory stores information relating to the image forming apparatus. The drum cartridge includes a photosensitive drum, a charger and a drum cartridge memory. The charger is configured to charge an outer periphery of the photosensitive drum. The drum cartridge memory stores information relating to the drum cartridge. The controller includes a voltage applying circuit and an abnormal discharge detection circuit. The voltage applying circuit is configured to apply voltage to the charger. The abnormal discharge detection circuit is configured to detect an abnormal discharge based on a current value of current flowing through the voltage applying circuit. The controller executes a storing process, a calculating process, a writing process, a test voltage applying process, a determination process and a deletion process. The storing process is a process of storing a detected voltage that is detected from the charger in the main memory at regular intervals. The calculating process is a process of, when occurrence of the abnormal discharge is detected by the abnormal discharge detection circuit, reading a first detected voltage from the main memory and calculating, based on the first detected voltage, a reference voltage being lower than the first detected voltage. The first detected voltage is a detected voltage that is detected at the charger just before the detection of the occurrence of the abnormal discharge by the abnormal discharge detection circuit. The writing process is a process of storing an executed number of a test voltage application in the drum cartridge memory. The test voltage applying process is a process of, after calculating the reference voltage, causing the voltage applying circuit to apply, to the charger, a voltage that is lower than an applying voltage that had been applied to the charger when the abnormal discharge detection circuit detected the occurrence of the abnormal discharge. The determination process is a process of determining whether or not a detected voltage detected at the charger when the test voltage applying process was executed is equal to or lower than the reference voltage. The deletion process is a process of, if it is determined in the determination process that the detected voltage detected at the charger when the test voltage applying process was executed is equal to or lower than the reference voltage, a deleting the executed number from the drum cartridge memory.

According to aspects of the present disclosures, there is further provided an image forming apparatus including a casing, a drum cartridge, a main memory and a controller. The drum cartridge is mountable on the casing. The drum cartridge includes a photosensitive drum, a charger and a drum cartridge memory. The charger is configured to charge an outer periphery of the photosensitive drum. The drum cartridge memory stores information relating to the drum cartridge. The main memory stores information relating to the image forming apparatus. The controller includes a voltage applying circuit and an abnormal discharge detection circuit. The voltage applying circuit is configured to apply voltage to the charger. The abnormal discharge detection circuit is configured to detect an abnormal discharge based on a current value of current flowing through the voltage applying circuit. The controller executes an abnormal discharge flag generation process, a test voltage applying process, a voltage determination process and an abnormal discharge flag deletion process. The abnormal discharge flag generation process is a process of, when occurrence of the abnormal discharge is detected by the abnormal discharge detection circuit, storing an abnormal discharge flag in the drum cartridge memory. The test voltage applying process is a process of, after storing the abnormal discharge flag in the drum cartridge memory, causing the voltage applying circuit to apply a test voltage to the charger. The voltage determination process is a process of determining whether or not a detected voltage detected at the charger when the test voltage was applied to the charger is equal to or lower than a particular reference voltage. The abnormal discharge flag deletion process is a process of, if it is determined in the voltage determination process that the detected voltage detected at the charger when the test voltage was applied to the charger is equal to or lower than the particular reference voltage, deleting the abnormal discharge flag.

BRIEF DESCRIPTION OF THE ACCOMPANYING DRAWINGS

FIG. 3 is a flowchart, according to a first embodiment, illustrating processes to be executed by a controller when a cover is opened and closed in a state where power of the image forming apparatus is on.

DETAILED DESCRIPTION

Hereinafter, embodiments of the present disclosures will be described with reference to the accompanying drawings.

Configuration of Image Forming Apparatus

Figure 1:
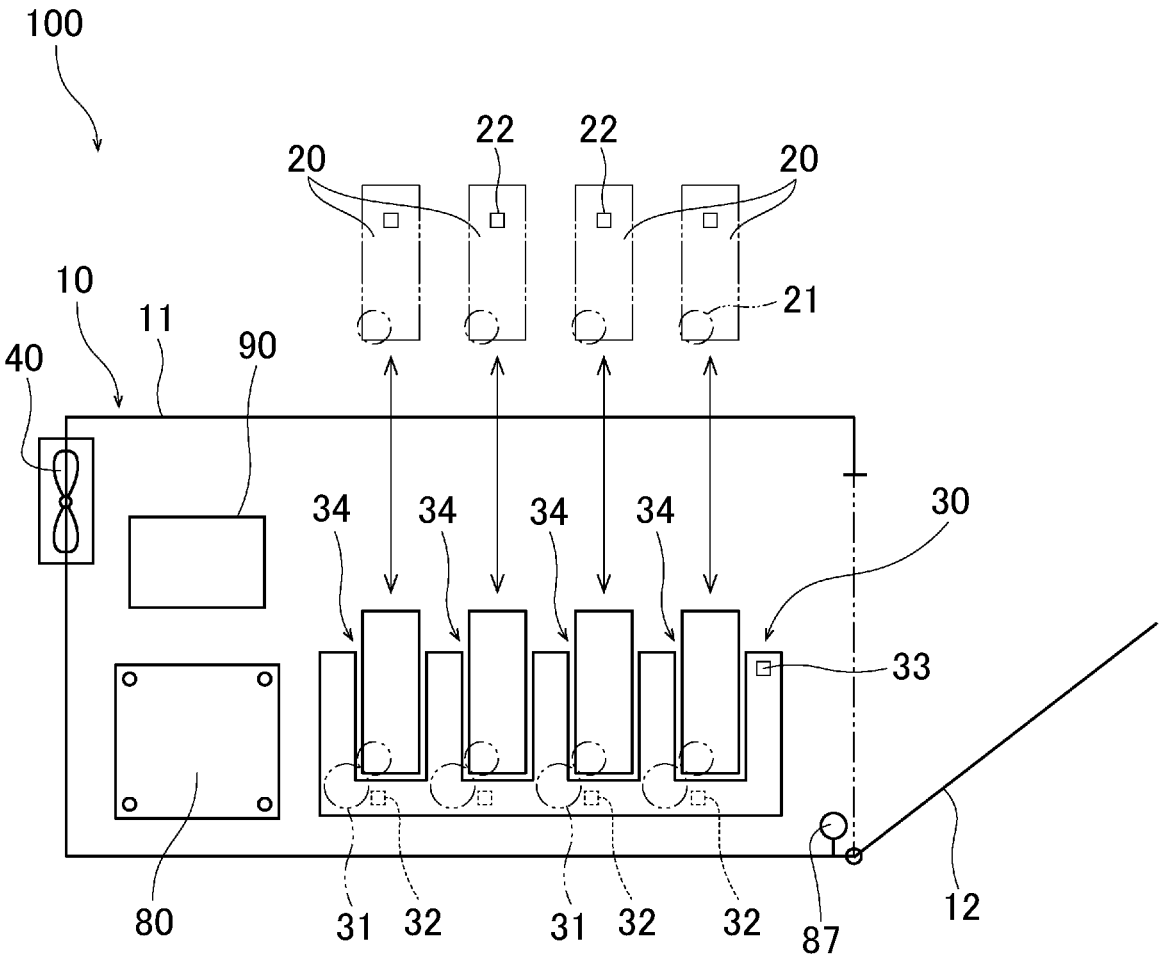
FIG. 1 is a schematic side view of an image forming apparatus.

FIG. 1 is a schematic view of an image forming apparatus 100. The image forming apparatus 100 is an electrophotographic printer. Examples of the image forming apparatus 100 are laser printers and LED printers. As shown in FIG. 1, the image forming apparatus 100 includes a casing 10, four toner cartridges 20, a drum cartridge 30, a fan 40, a controller 80 and a display 90.

The casing 10 includes a box-like main frame 11 and a cover 12. The four toner cartridges 20, the drum cartridge 30 and the controller 80 are accommodated in an inner space of the main frame 11 of the casing 10. The display 90 is arranged on an outer surface of the main frame 11. The main frame 11 has an opening. The cover 12 is swingable between a closed position shown with chain double-dashed lines in FIG. 1 and an open position shown with solid lines in FIG. 1. In a case where the cover 12 is at the closed position, the opening of the main frame 11 is covered with the cover 12. In a case where the cover 12 is at the open position, the opening of the main frame 11 is exposed to outside. The main frame 11 further includes a sensor 87 configured to detect the movement of the cover 12 between the open position and the closed position. The sensor 87 is electrically connected to the controller 80.

Each toner cartridge 20 is attachable to and detachable from the drum cartridge 30. Each toner cartridge 20 has a body configured to accommodate toner being developer. The four toner cartridges 20 respectively accommodate toner of different colors (e.g., cyan, magenta, yellow and black). Each toner cartridge 20 also includes a developing roller 21. The developing roller 21 is a cylindrical member extending along a developing axis. The developing roller 21 is rotatable about the developing axis. Each toner cartridge 20 further includes a toner cartridge memory 22. The toner cartridge memory 22 is a readable and writable storage medium. The toner cartridge memory 22 is, for example, a flash ROM or an EEPROM. The toner cartridge memory 22 stores, for example, toner cartridge identification information for identifying each toner cartridge 20 and a toner cartridge life information indicating life of the toner cartridge 20.

The drum cartridge 30 is attachable to and detachable from the main frame 11. The drum cartridge 30 has four slots 34 for the four toner cartridges 20. The four toner cartridges 20 are inserted in the four respective slots 34.

The drum cartridge 30 includes four photosensitive drums 31, four chargers 32, and a drum cartridge memory 33.

The photosensitive drums 31 are provided to respective slots 34. The photosensitive drums 31 are cylindrical members extending along respective drum axes. The photosensitive drums 31 are rotatable about respective drum axes. In a state where the toner cartridges 20 are mounted to the drum cartridge 30, outer peripheries of the photosensitive drums 31 contact outer peripheries of respective developing rollers 21. The toner is supplied from the toner cartridges 20 to the photosensitive drums 31 to form toner images thereon, respectively. The toner images respectively formed on the photosensitive drums 31 are transferred onto a printing paper.

The chargers 32 are provided to respective slots 34. The chargers 32 are devices configured to charge the outer peripheries of respective photosensitive drums 31. In the embodiments of the present disclosures, the chargers 32 are scorotron chargers each having a wire and a grid. An "applying voltage" which will be mentioned later is a voltage that is to be applied to the wire and the grid. A "detected voltage" which will be mentioned later is a voltage that is detected from the wire when the applying voltage is applied to the wire and the grid. The charger 32 may be of other types such as a charging roller.

The drum cartridge memory 33 stores pieces of information relating to the drum cartridge 30. Specifically, the drum cartridge memory 33 stores at least one of drum cartridge identification information for identifying each drum cartridge 33, one or more life count values, represented by information, relating to life of the drum cartridge 30, and discharge history information being information relating to abnormal discharges of the chargers 32 occurred in the past. The drum cartridge identification information is, for example, a serial number. The one or more life count values are at least one of a cumulative number of rotations of the photosensitive drums 31, a cumulative number of sheets printed using the photosensitive drums 31, and a cumulative number of dots printed using the photosensitive drums 31. In the embodiments of the present disclosures, all the three numbers are stored in the drum cartridge memory 33 as the life count values.

The cumulative number of rotations of the photosensitive drums 31 is a number of rotations that is incremented or decremented, for each drum cartridge 30 identified by the drum cartridge identification information, each time printing is executed. The cumulative number of sheets printed using the photosensitive drums 31 is a number of sheets printed that is incremented or decremented, for each drum cartridge 30, each time printing is executed. The cumulative number of dots printed using the photosensitive drums 31 is a number of dots printed that is incremented or decremented, for each drum cartridge 30, each time printing is executed.

The discharge history information includes pieces of information that was stored in the drum cartridge memory 33 each time the abnormal discharge was detected by an abnormal discharge detection circuit 84 which will be described later. The discharge history information includes a history of the abnormal discharges which is stored in a state where, for each abnormal discharge, a piece of information indicating the fact that the abnormal discharge occurred and the life count values of the drum cartridge 30 at the time the abnormal discharge occurred are associated with each other.

The fan 40 is driven to rotate by a conventionally known motor. The fan 40 draws air within an inner space of the main frame 11 to outside. The motor that drives the fan 40 to rotate is electrically connected to the controller 80.

The controller 80 includes a processor 81 such as a CPU, a main memory 82, a voltage applying circuit 83, and the abnormal discharge detection circuit 84. The main memory 82 is a readable and writable storage medium. The main memory 82 is, for example, a flash ROM or an EEPROM. The main memory 82 may be or may not be included in the controller 80.

The main memory 82 stores one or more computer programs for controlling operation of the image forming apparatus 100. The processor 81 executes various processes in accordance with the one or more computer programs stored in the main memory 82.

The voltage applying circuit 83 applies the applying voltage to the wires and the grids of the chargers 32. The abnormal discharge detection circuit 84 detects occurrence of the abnormal discharge based on a current value of current that flows through a transformer of the voltage applying circuit 83. Specifically, the abnormal discharge detection circuit 84 detects occurrence of the abnormal discharge when current that is equal to or more than a threshold current value flows through the transformer of the voltage applying circuit 83 which is applying voltage on the wires and the grids. More specifically, the abnormal discharge detection circuit 84 is an overcurrent detection circuit. The abnormal discharge is a discharge such as a spark discharge that is different from a corona discharge which is a normal discharge.

The display 90 is electrically connected to the controller 80. The display 90 displays pieces of information relating to operations of the image forming apparatus 100, errors, alerts and the like based on display data received from the controller 80.

Figure 2:
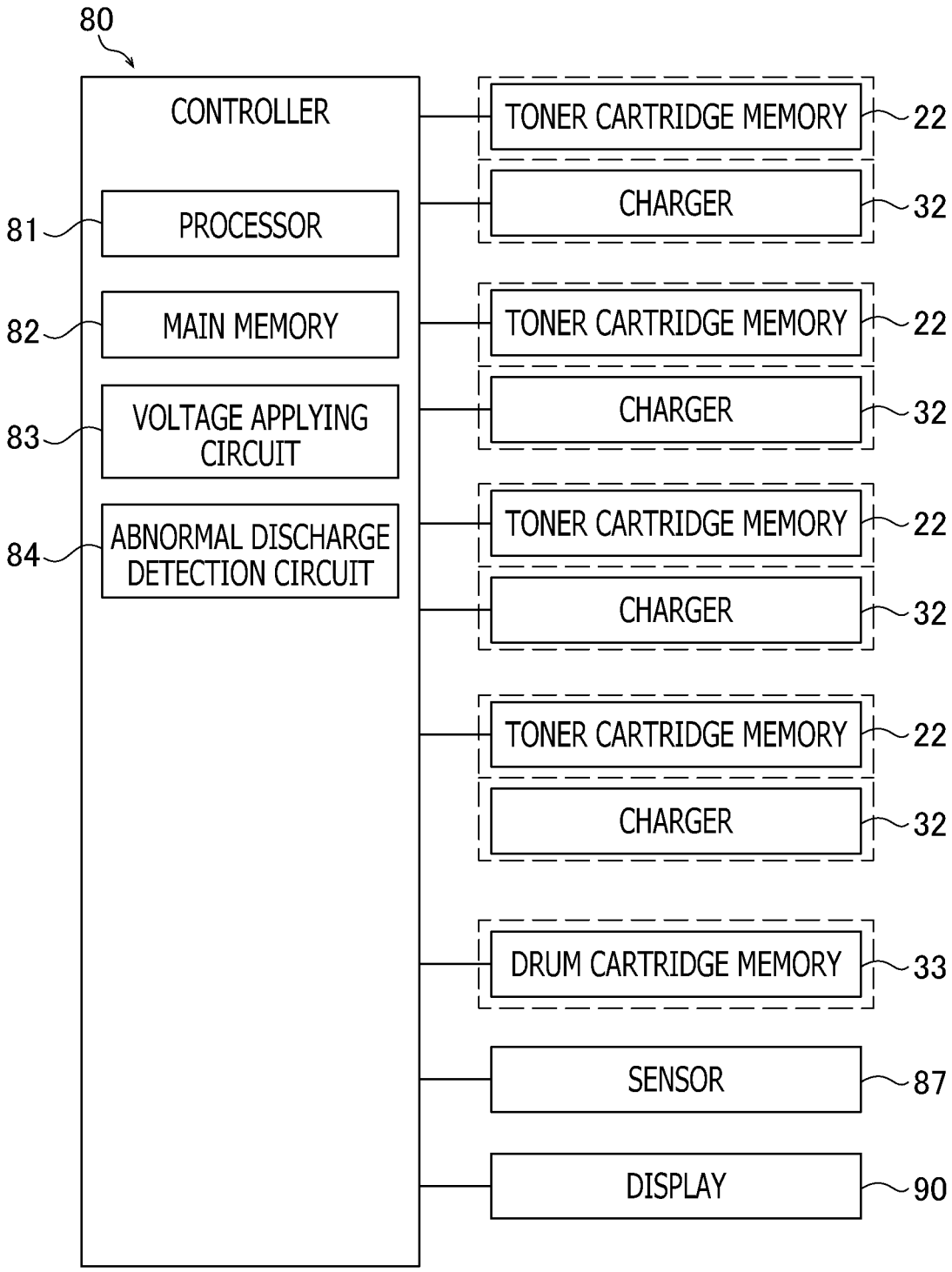
FIG. 2 is a block diagram showing an electrical configuration of the image forming apparatus.

FIG. 2 shows electrical connections between the controller 80 and the drum cartridge memory 33 and toner cartridge memories 22 in a state where the drum cartridge 30 to which the toner cartridges 20 are mounted is mounted to the main frame 11. FIG. 2 also shows an electrical connection between the controller 80 and the display 90 and an electrical connection between the controller 80 and the sensor 87. In the state where the drum cartridge 30 to which the toner cartridges 20 are mounted is mounted to the main frame 11, the drum cartridge memory 33 is electrically connected to the controller 80 via one or more conventionally known connectors and/or wirings. The processor 81 thereby becomes able to read and write information from and to the drum cartridge memory 33. Furthermore, in the state where the drum cartridge 30 to which the toner cartridges 20 are mounted is mounted to the main frame 11, the toner cartridge memories 22 are also electrically connected to the controller 80. The processor 81 thereby becomes able to read and write information from and to the toner cartridge memories 22.

The controller 80 drives conventionally-known motors when executing printing. The photosensitive drums 31 and the developing rollers 21 rotate due to the driving forces of these motors. The controller 80 also applies voltage to the chargers 32, and the outer peripheries of the photosensitive drums 31 are thereby charged. The controller 80 further causes conventionally-known light source units to emit lights. The lights are irradiated on the outer peripheries of respective photosensitive drums 31. Electrostatic latent images for an image to be printed are thereby formed on the outer peripheries of respective photosensitive drums 31. Toner in the toner cartridges 20 are supplied to the electrostatic latent images on the photosensitive drums 31 via respective developing rollers 21. Toner images are thereby formed on the outer peripheries of the photosensitive drums 31. Thereafter, a printing paper is conveyed between the photosensitive drums 31 and a conventionally-known transfer belt. The toner images are thereby transferred from the outer peripheries of the photosensitive drums 31 to the printing paper. The printing paper on which the toner images are transferred is conveyed to a conventionally-known fixing unit of the image forming apparatus 100. The toner images transferred to the printing paper is thereby thermally fixed on the printing paper. As a result, an image is printed on the printing paper.

The configuration of the image forming apparatus 100 is not limited to the one described above. For example, in place of the drum cartridge 30 to which four toner cartridges 20 are mounted, a plurality of drum cartridges, each drum cartridge to which one toner cartridge is mounted, may be mounted to the casing 10. In this case, the drum cartridge to which one toner cartridge is mounted includes one photosensitive drum and one charger. Also, a toner cartridge which does not include a developing roller may be used. In this case, a developing roller may be provided to a drum cartridge.

1. First Embodiment

Hereinafter, a first embodiment of the present disclosures will be described with reference to FIGS. 3-6. In the first embodiment, the processor 81 executes a reading process, a discharge interval determination process, a discharge history information updating process, a first determination process, a second determination process, a cleaning request displaying process, a drum cartridge replacement request displaying process and a printing non-permission process which will be described later.

<1-1. Processes after Opening and Closing Cover when Power is On>

Processes to be executed by the controller 80 in a case where the cover 12 is opened and closed in a state where power of the image forming apparatus 100 is on will be described with reference to FIGS. 3 and 4.

Figure 3:
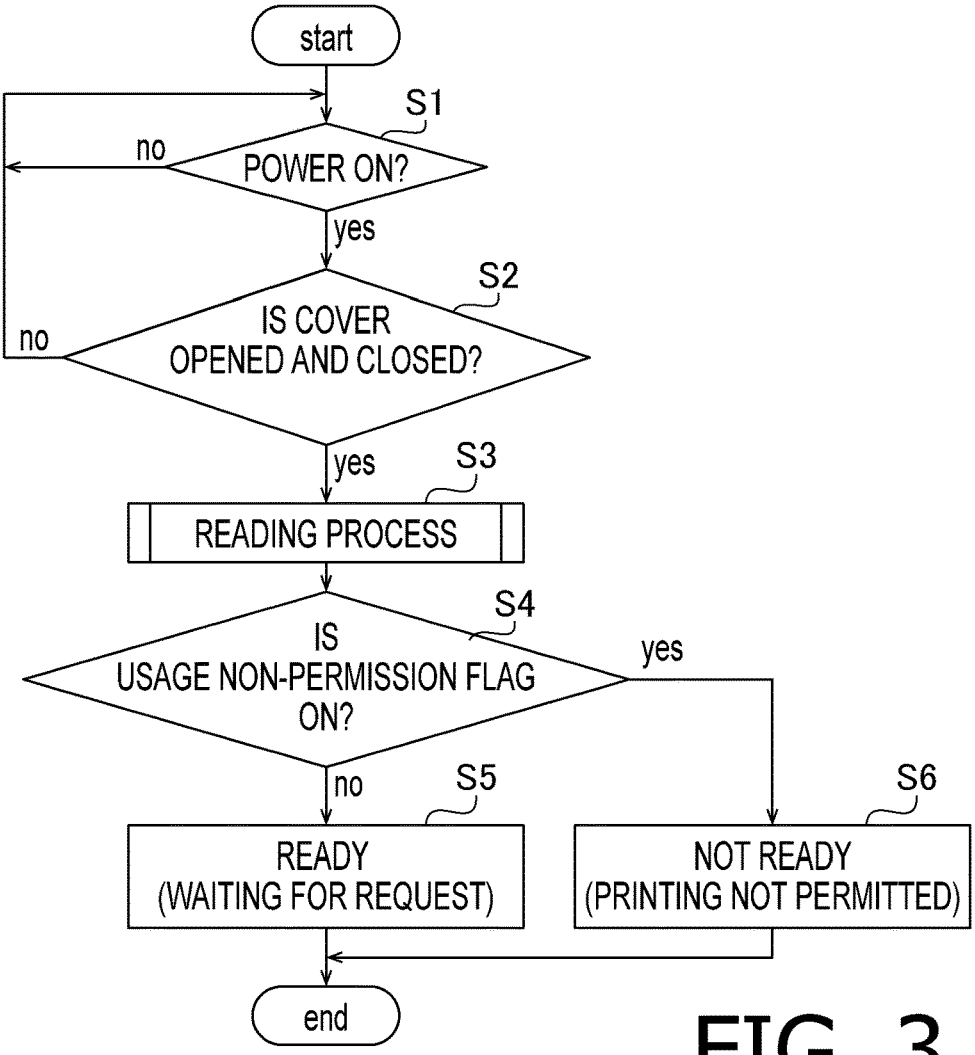

FIG. 3 shows, with a flow chart, a flow of processes to be executed by the controller 80 for causing the image forming apparatus 100 to standby for printing. As shown in FIG. 3, the controller 80 determines whether the power of the image forming apparatus 100 is on (Step S1) and whether the cover 12 of the casing 10 is opened and closed (Step S2).

In a case where it is determined that the cover 12 of the casing 10 moves from the open position to the closed position (Step S2: YES) in a state where the power of the image forming apparatus 100 is on (Step S1: YES), the controller 80 executes a reading process (Step S3) for reading information in the drum cartridge memory 33. In the reading process, the controller reads pieces of information stored in the drum cartridge memory 33. After the reading process, the controller 80 determines whether a usage non-permission flag which will be described later is on (Step S4). The usage non-permission flag is information that is to be stored in the drum cartridge memory 33 at Step S49 or Step S52 which will be described later.

In a case where it is determined in Step S4 that the usage non-permission flag is on (Step S4: YES), the controller 80 switches the image forming apparatus 100 into a "not ready (printing not permitted)" state. That is, the controller 80 switches the image forming apparatus 100 into a state that does not accept print requests (print jobs).

On the other hand, in a case where it is determined in Step S4 that the usage non-permission flag is off (Step S4: NO), the controller 80 switches the image forming apparatus 100 into a "ready (waiting for request)" state. That is, the controller 80 switches the image forming apparatus 100 into a state for waiting print requests and causes the image forming apparatus 100 to standby for printing.

<1-2. Reading Process of Information Stored in Drum Cartridge Memory>

Next, the reading process of the information in the drum cartridge memory 33 (Step S3) to be executed by the controller 80 will be described in more details with reference to FIG. 4. FIG. 4 is a flowchart illustrating the reading process of the information in the drum cartridge memory 33 to be executed by the controller 80.

Figure 4:
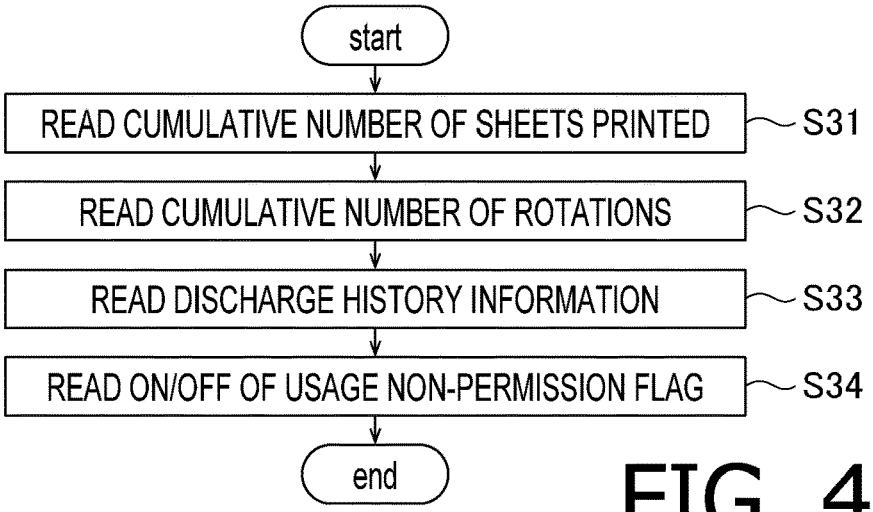
FIG. 4 is a flowchart, according to the first embodiment, illustrating a reading process to be executed by the controller to read information in a drum cartridge memory.

As shown in FIG. 4, upon the reading process of the information in the drum cartridge memory 33 is started, the controller 80 reads the cumulative number of sheets printed using the photosensitive drums 31 from the drum cartridge memory 33 (Step S31). Then, the controller 80 reads the cumulative number of rotations of the photosensitive drums 31 from the drum cartridge memory 33 (Step S32). Then, the controller 80 reads the discharge history information of the charger 32 from the drum cartridge memory 80 (Step S33). Then, the controller 80 reads information indicating whether the usage non-permission flag is on or off from the drum cartridge memory 33 (Step S34).

In the image forming apparatus 100 of the first embodiment, as described above, the controller 80 can switch the status of the image forming apparatus 100 between the state where printing is allowed and the state where printing is not permitted based on the information indicating whether the usage non-permission flag is on or off that is read from the drum cartridge memory 33.

<1-3. Process after Occurrence of Error>

Figure 5:
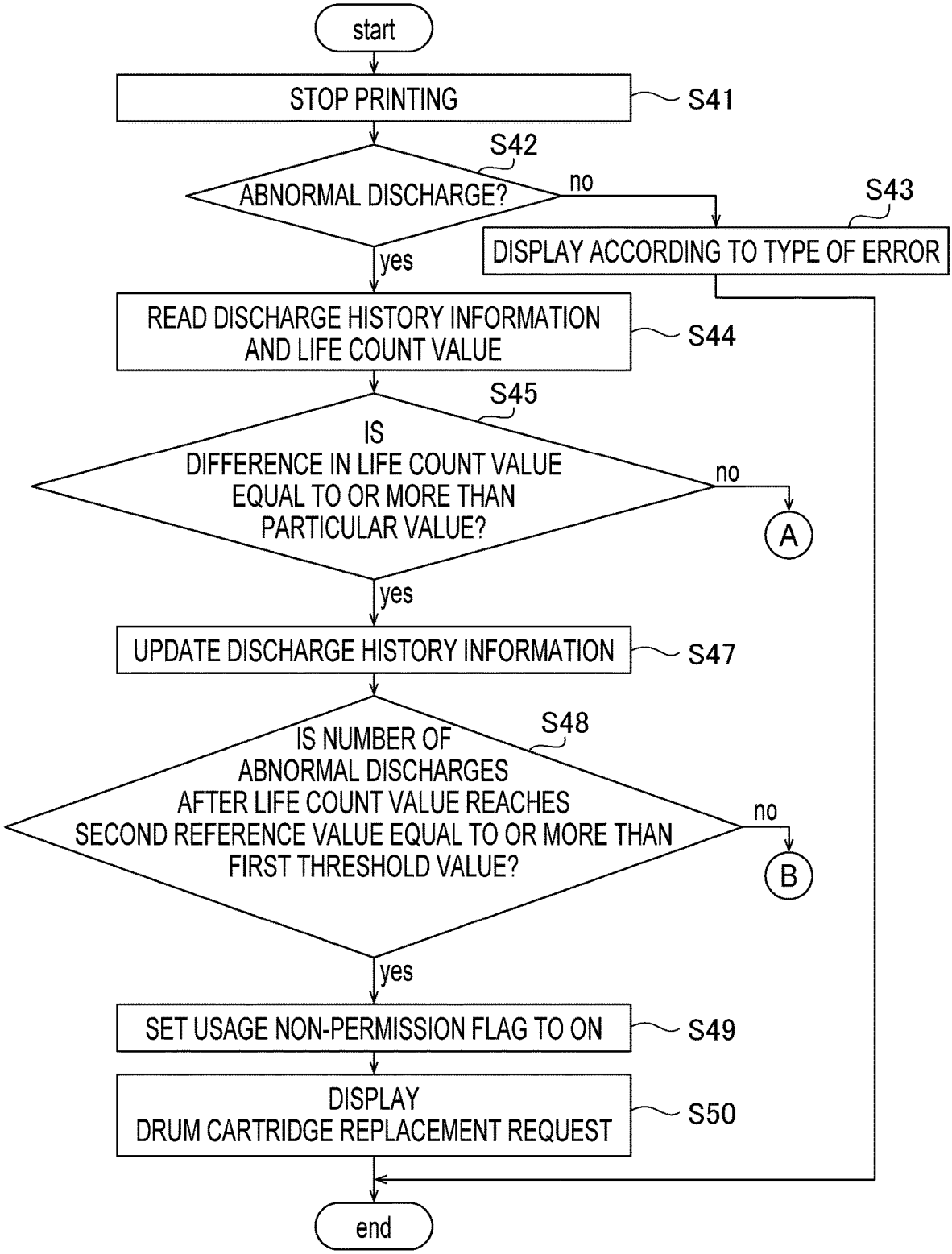
FIGS. 5 and 6 show a flowchart, according to the first embodiment, illustrating processes to be executed by the controller in a case where an error occurred.
Figure 6:
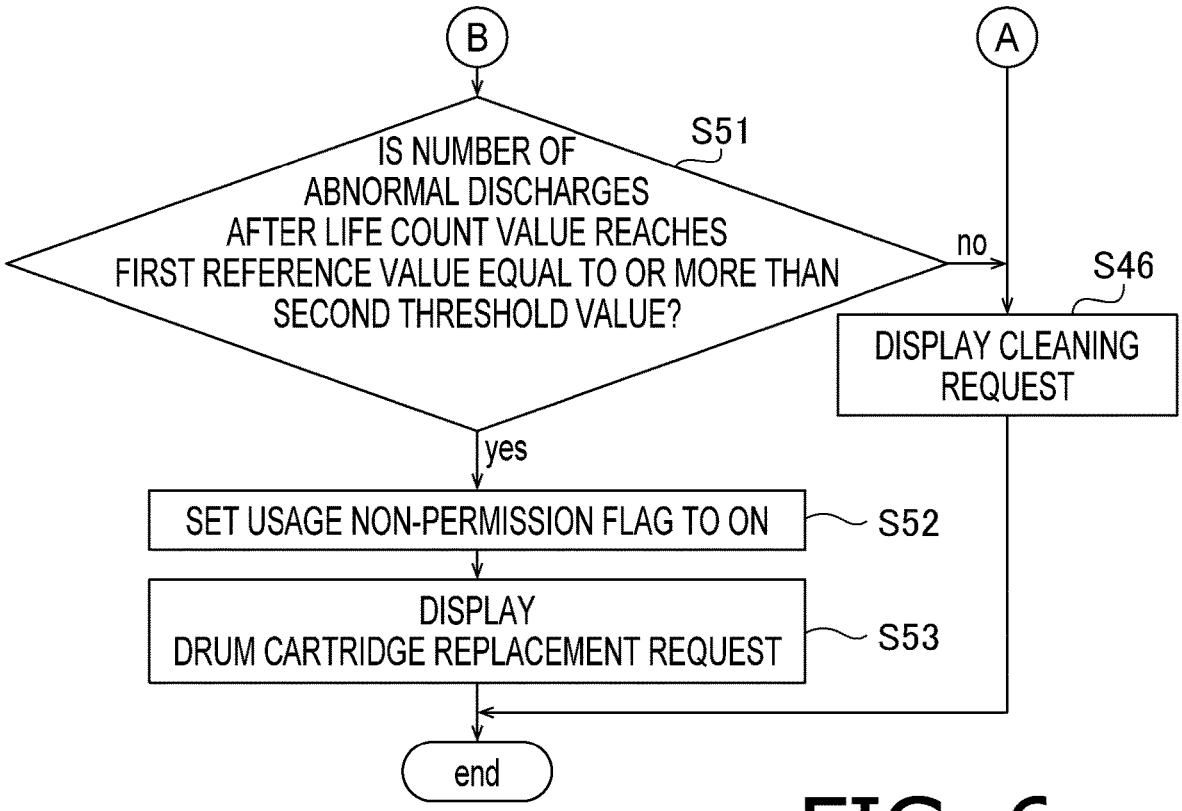

Next, a flow of processes to be executed by the controller 80 in a case where an error is detected will be described with reference to FIGS. 5 and 6. FIGS. 5 and 6 show a flowchart illustrating processes to be executed by the controller 80 in a case where an error is detected.

In a case where the controller 80 detects occurrence of some kind of an error based on signals from sensors or the like that are electrically connected to the controller 80, the controller 80 stops driving the motors and causes the image forming apparatus 100 to stop printing (Step S41).

After causing the image forming apparatus 100 to stop printing, the controller 80 determines whether or not the detected error is the abnormal discharge based on the detection result by the abnormal discharge detection circuit 84 (Step S42). Specifically, the abnormal discharge detection circuit 84 detects the abnormal discharge in a case where the current value of the current flowing through the transformer of the voltage applying circuit 83 exceeds a threshold value. The controller determines that the detected error is the abnormal discharge in a case where the abnormal discharge detection circuit 84 detects the abnormal discharge. The controller determines that the detected error is an error other than the abnormal discharge in a case where the abnormal discharge detection circuit 84 do not detect the abnormal discharge.

In a case where it is determined that the detected error is an error other than the abnormal discharge (Step S42: NO), the controller 80 displays a message on the display 90 in accordance with a type of the detected error.

In a case where it is determined that the detected error is the abnormal discharge (Step S42: YES), the controller 80 reads the discharge history information from the drum cartridge memory 33 (Step S44). In Step S44, the controller 80 further reads the life count values at the time the current error occurred from the drum cartridge memory 33. Specifically, the controller 80 reads the cumulative number of rotations of the photosensitive drums 31, the cumulative number of sheets printed using the photosensitive drums 31, or the cumulative number of dots printed using the photosensitive drums 31 from the drum cartridge memory 33.

After reading the discharge history information from the drum cartridge memory 33, the controller 80 reads the life count values at the time the current error occurred from the drum cartridge memory 33. The controller 80 determines whether differences between the life count values (i.e., the cumulative number of rotations of the photosensitive drums 31, the cumulative number of sheets printed using the photosensitive drums 31, and the cumulative number of dots printed using the photosensitive drums 31), included in the discharge history information, at the time a previous abnormal discharge occurred and the life count values, read from the drum cartridge memory 33, at the time the current abnormal discharge occurred are equal to more than particular values, the particular values being set for each of the cumulative number of rotations of the photosensitive drums 31, the cumulative number of sheets printed using the photosensitive drums 31, and the cumulative number of dots printed using the photosensitive drums 31 (Step S45: discharge interval determination process).

In a case where it is determined in the discharge interval determination process that the differences between the cumulative number of rotations of the photosensitive drums 31, the cumulative number of sheets printed using the photosensitive drums 31, and the cumulative number of dots printed using the photosensitive drums 31 at the time the previous abnormal discharge occurred and those at the time the current abnormal discharge occurred are all less than the particular values (Step S45: NO), the controller 80 does not add information relating to the current abnormal discharge to the discharge history information stored in the drum cartridge memory 33 and executes Step S46 (cleaning request displaying process). That is, in a case where the interval between the abnormal discharges is short, since it is likely that a user did not perform cleaning of the chargers 32 or that the cleaning was insufficient, the controller 80 does not regard the current abnormal discharge as a newly occurred error.

In the cleaning request displaying process, the controller 80 causes the display 90 to display a message prompting the user to perform cleaning of the chargers 32 (more specifically, the wires of the chargers 32). In the cleaning request displaying process, the controller 80 may also cause the display 90 to display, for example, an illustration showing a method for cleaning the wires.

On the other hand, in a case where it is determined in the discharge interval determination process that at least one of the differences between the cumulative number of rotations of the photosensitive drums 31, the cumulative number of sheets printed using the photosensitive drums 31, and the cumulative number of dots printed using the photosensitive drums 31 at the time the previous abnormal discharge occurred and those at the time the current abnormal discharge occurred is equal to or more than the particular values (Step S45: YES), the controller 80 executes Step S47 (discharge history information updating process).

In the discharge history information updating process, the controller 80 writes, on the drum cartridge memory 33, information indicating the fact that the abnormal discharge occurred and the life count values of the drum cartridge 30 at the time the current abnormal discharge occurred while associating these pieces of information with each other. That is, in a case where the interval between the abnormal discharges is not short, since it is likely that the abnormal discharge occurred not because a user did not perform cleaning of the chargers 32 or that the cleaning was insufficient but because of other factors, the controller 80 stores information relating to the current abnormal discharge in the drum cartridge memory 33.

After the discharge history information updating process, the controller 80 executes a first determination process (Step S48). In the first determination process, the controller 80 determines whether or not a number of abnormal discharges, detected by the abnormal discharge detection circuit 84 after it is determined by the controller 80 that the life count values read from the drum cartridge memory 33 reaches second reference values being greater than first reference values, is equal to or more than a first threshold value. The "first reference values" are, for example, the life count values corresponding to a time for replacement of the drum cartridge 30. The "second reference values" are, for example, twice the life count values corresponding to the time for replacement of the drum cartridge 30. The "first threshold value" is, for example, one. That is, in the first determination process, the controller 80 determines whether or not the abnormal discharge occurred for equal to more than the first threshold number (e.g., once) after the life count values of the drum cartridge 30 reaches the second reference values (e.g., twice the life count values corresponding to the time for replacement of the drum cartridge 30) being greater than the first reference values (e.g., the life count values corresponding to the time for replacement of the drum cartridge 30).

In a case where it is determined in the first determination process that the number of abnormal discharges, detected by the abnormal discharge detection circuit 84 after it is determined by the controller 80 that the life count values read from the drum cartridge memory 33 reaches the second reference values being greater than the first reference values, is equal to or more than the first threshold value (Step S48: YES), the controller 80 sets the usage non-permission flag to "ON" (Step S49). That is, in Step S49, in a case where the abnormal discharge occurred for equal to more than the first threshold number (e.g., once) after the life count values of the drum cartridge 30 reaches the second reference values (e.g., twice the life count values corresponding to the time for replacement of the drum cartridge 30) being greater than the first reference values (e.g., the count values corresponding to the time for replacement of the drum cartridge 30), the controller 80 sets the usage non-permission flag to "ON" to not permit subsequent printing. Specifically, the controller 80 stores information indicating that the usage non-permission flag is "ON" in the drum cartridge memory 33.

After Step S49, the controller 80 executes a drum cartridge replacement request displaying process (Step S50). Specifically, in the drum cartridge replacement request displaying process, the controller 80 causes the display 90 to display a message prompting a user to replace the drum cartridge 30. In the drum cartridge replacement request displaying process, the controller 80 may also cause the display 90 to display, for example, an illustration showing a method for replacing the drum cartridge 30.

In a case where it is determined in the first determination process that the number of abnormal discharges, detected by the abnormal discharge detection circuit 84 after it is determined by the controller 80 that the life count values read from the drum cartridge memory 33 reaches second reference values being greater than the first reference values, is less than the first threshold value (Step S48: NO), the controller 80 executes a second determination process (Step S51).

In the second determination process, the controller 80 determines whether or not the number of abnormal discharges, detected by the abnormal discharge detection circuit 84 after it is determined by the controller 80 that the life count values read from the drum cartridge memory 33 reaches the first reference values, is equal to or more than a second threshold value. The "first reference values" are, for example, the life count values corresponding to a time for replacement of the drum cartridge 30 (i.e., life of the drum cartridge). The "second threshold value" is a value that is greater than the first threshold value and is, for example, two. That is, in the second determination process, the controller 80 determines whether or not the abnormal discharge occurred for equal to more than the second threshold number (e.g., twice) after the life count values of the drum cartridge 30 reaches the first reference values (e.g., the count values corresponding to the life of the drum cartridge 30).

In a case where it is determined in the second determination process that the number of abnormal discharges, detected by the abnormal discharge detection circuit 84 after it is determined by the controller 80 that the life count values read from the drum cartridge memory 33 reaches the first reference values, is less than the second threshold value (Step S51: NO), the controller 80 executes the cleaning request displaying process for causing the display 90 to display the message prompting a user to perform cleaning of the charger (Step S46).

On the other hand, in a case where it is determined in the second determination process that the number of abnormal discharges, detected by the abnormal discharge detection circuit 84 after it is determined by the controller 80 that the life count values read from the drum cartridge memory 33 reaches the first reference values, is equal to or more than the second threshold value (Step S51: YES), the controller 80 sets the usage non-permission flag to "ON" (Step S52). That is, in Step S52, in a case where the abnormal discharge occurred for equal to more than the second threshold number (e.g., twice) after the life count values of the drum cartridge 30 reaches the first reference values (e.g., the count values corresponding to the life of the drum cartridge 30), the controller 80 sets the usage non-permission flag to "ON" to not permit subsequent printing. Specifically, the controller 80 stores the information indicating that the usage non-permission flag is "ON" in the drum cartridge memory 33.

After Step S52, the controller executes a drum cartridge replacement request displaying process (Step S53). Specifically, in the drum cartridge replacement request displaying process, the controller 80 causes the display 90 to display a message prompting a user to replace the drum cartridge 30. In the drum cartridge replacement request displaying process, the controller 80 may also cause the display 90 to display, for example, an illustration showing a method for replacing the drum cartridge 30.

<1-4. Summary of First Embodiment>

As described above, the image forming apparatus 100 of the first embodiment includes the drum cartridge 30 and the controller 80. The controller 80 includes the abnormal discharge detection circuit 84. In a case where the abnormal discharge detection circuit 84 detects occurrence of the abnormal discharge, in a case where the life count values read from the drum cartridge memory 33 reaches the first reference value and the number of abnormal discharges, included in the discharge history information read from the drum cartridge memory 33 is equal to or more than a particular threshold value (Step S51: YES), the controller 80 does not permit printing. On the other hand, in a case where the life count values read from the drum cartridge memory 33 reaches the first reference value but the number of abnormal discharges, included in the discharge history information read from the drum cartridge memory 33 is less than the particular threshold value (Step S51: NO), the controller 80 permits printing. Therefore, even after the drum cartridge 30 reaches the end of life, the drum cartridge 30 can be used for printing unless the discharge history information satisfies a particular condition. Also, the controller 80 reads the life count values and the discharge history information from the drum cartridge memory 33 and determines, based on these pieces of information, whether to permit printing using the drum cartridge 30. As a result, the drum cartridge 30 can be monitored appropriately even in a case where the drum cartridge 30 that was used in one image forming apparatus 100 is mounted to another image forming apparatus 100.

The image forming apparatus 100 of the first embodiment further includes the display 90. In a case where the abnormal discharge is detected by the abnormal discharge detection circuit 84, the controller 80 executes the discharge interval determination process (Step S45) of determining whether the differences between the life count values, read from the drum cartridge memory 33, at the time the current abnormal discharge occurred and the life count values, included in the discharge history information read from the drum cartridge memory 33, at the time the previous abnormal discharge occurred are equal to more than particular values that are set for each of the cumulative number of rotations of the photosensitive drums 31, the cumulative number of sheets printed using the photosensitive drums 31, and the cumulative number of dots printed using the photosensitive drums 31 (Step S45: discharge interval determination process). In a case where it is determined that the differences are less than the particular values, the controller 80 executes the cleaning request displaying process (Step S46) of causing the display 90 to display the message prompting a user to perform cleaning of the chargers 32. In a case where the differences between the life count values at the time the previous abnormal discharge occurred and those at the time the current abnormal discharge occurred are less than the particular values (Step S45: NO), it is likely that a user did not perform cleaning of the chargers 32 or that the cleaning was insufficient. In such a case, according to the first embodiment, it is possible to prompt a user to perform cleaning of the chargers 32.

In the image forming apparatus 100 of the first embodiment, the controller 80 can execute the discharge history updating process (Step S47) of storing information indicating the fact that the abnormal discharge occurred and the life count values at the time the current abnormal discharge occurred in the drum cartridge memory 33 as the discharge history information in a case where it is determined in the discharge interval determination process that the differences between the life count values, read from the drum cartridge memory 33, at the time the current abnormal discharge occurred and the life count values, included in the discharge history information read from the drum cartridge memory 33, at the time the previous abnormal discharged occurred are equal to more than particular values. In a case where the differences between the life count values at the time the current abnormal discharge occurred and the life count values at the time the previous abnormal discharged occurred are equal to more than particular values, it is likely that the abnormal discharge is not the one that occurred because a user switched on the image forming apparatus 100 or opened and closed the cover 12 in a state where cleaning of the chargers 32 by the user is insufficient but is a newly occurred one. In such a case, according to the first embodiment, the drum cartridge 30 can be monitored appropriately by storing the information relating to the current abnormal discharge in the drum cartridge memory 33 as the discharge history information.

In the image forming apparatus 100 of the first embodiment, after the discharge history information updating process (Step S47), the controller 80 can execute the first determination process (Step S48) of determining whether or not the number of abnormal discharges, detected by the abnormal discharge detection circuit 84 after it is determined by the controller 80 that the life count values read from the drum cartridge memory 33 reaches the second reference values being greater than the first reference values, is equal to or more than the first threshold value. If it is determined by the controller 80 in the first determination process that the number of abnormal discharges, detected by the abnormal discharge detection circuit 84 after it is determined by the controller 80 that the life count values reaches second reference values, is equal to or more than the first threshold value (Step S48: YES), the controller 80 can execute a printing non-permission process (Step S49 and Step S6) of not permitting printing using the drum cartridge 30. By this configuration, in a case where the abnormal discharge occurred for equal to more than the first threshold number (e.g., once) after the life count values of the drum cartridge 30 reaches the second reference values (e.g., twice the life count values corresponding to the life of the drum cartridge 30) being greater than the first reference values (e.g., the count values corresponding to the life of the drum cartridge 30), the controller 80 is capable of not permitting printing using the drum cartridge 30. Therefore, the drum cartridge 30 can be monitored appropriately.

In the image forming apparatus 100 of the first embodiment, the controller 80 can execute the second determination process (Step S51) of determining whether or not the number of abnormal discharges, detected by the abnormal discharge detection circuit 84 after it is determined by the controller 80 that the life count values reaches the first reference values, is equal to or more than the second threshold value in a case where it is determined by the controller 80 in the first determination process (Step S48) that the number of abnormal discharges, detected by the abnormal discharge detection circuit 84 after it is determined by the controller 80 that the life count values reaches second reference values being greater than the first reference values, is less than the first threshold value. Further, the controller 80 can execute the printing non-permission process (Step S52 and Step S6) of not permitting printing using the drum cartridge 30 in a case where it is determined by the controller 80 in the second determination process (Step S51) that the number of abnormal discharges, detected by the abnormal discharge detection circuit 84 after it is determined by the controller 80 that the life count values reaches the first reference values, is equal to or more than the second threshold value. By this configuration, in a case where the abnormal discharge occurred for equal to more than the second threshold number (e.g., twice) after the life count values of the drum cartridge 30 reaches the first reference values (e.g., the life count values corresponding to the life of the drum cartridge 30), the controller 80 is capable of not permitting printing using the drum cartridge 30. Therefore, the drum cartridge 30 can be monitored appropriately.

In the image forming apparatus 100 of the first embodiment, the second reference value is greater than the first reference value. By this configuration, in a case where the drum cartridge 30 is used in a state where the life count values of the drum cartridge 30 are far exceeding the first reference values (e.g., the life count values corresponding to the life of the drum cartridge 30), printing can be not permitted even in a case where the number of occurrence of the abnormal discharge is small.

<1-5. Variations of First Embodiment>

The present disclosures are not limited to the above-described illustrative first embodiment.

In the above-described first embodiment, the life count values (the cumulative number of rotations of the photosensitive drums 31, the cumulative number of sheets printed using the photosensitive drums 31, and the cumulative number of dots printed using the photosensitive drums 31) are incremented each time printing is executed. However, the life count values may be decremented each time printing is executed. In case the life count values are to be decremented each time printing is executed, the first reference value in the above-described first embodiment needs to be made greater than the second reference value.

The discharge history information may include pieces of information of all the abnormal discharges occurred in the past, or the controller 80 may delete pieces of information of old abnormal discharges. For example, the controller 80 may delete pieces of information of the abnormal discharges that occurred before the life count values of the drum cartridge 30 reach the first references value and that do not correspond to the last abnormal discharge.

In the above-described first embodiment, the second reference values are twice the life count values corresponding to the time for replacement of the drum cartridge 30. However, the second reference values only need to be values that are equal to or more than the life count values corresponding to the time for replacement of the drum cartridge 30.

Furthermore, elements appearing in the above described first embodiment and variations may be appropriately combined provided the combination is consistent.

2. Second Embodiment

Figure 8:
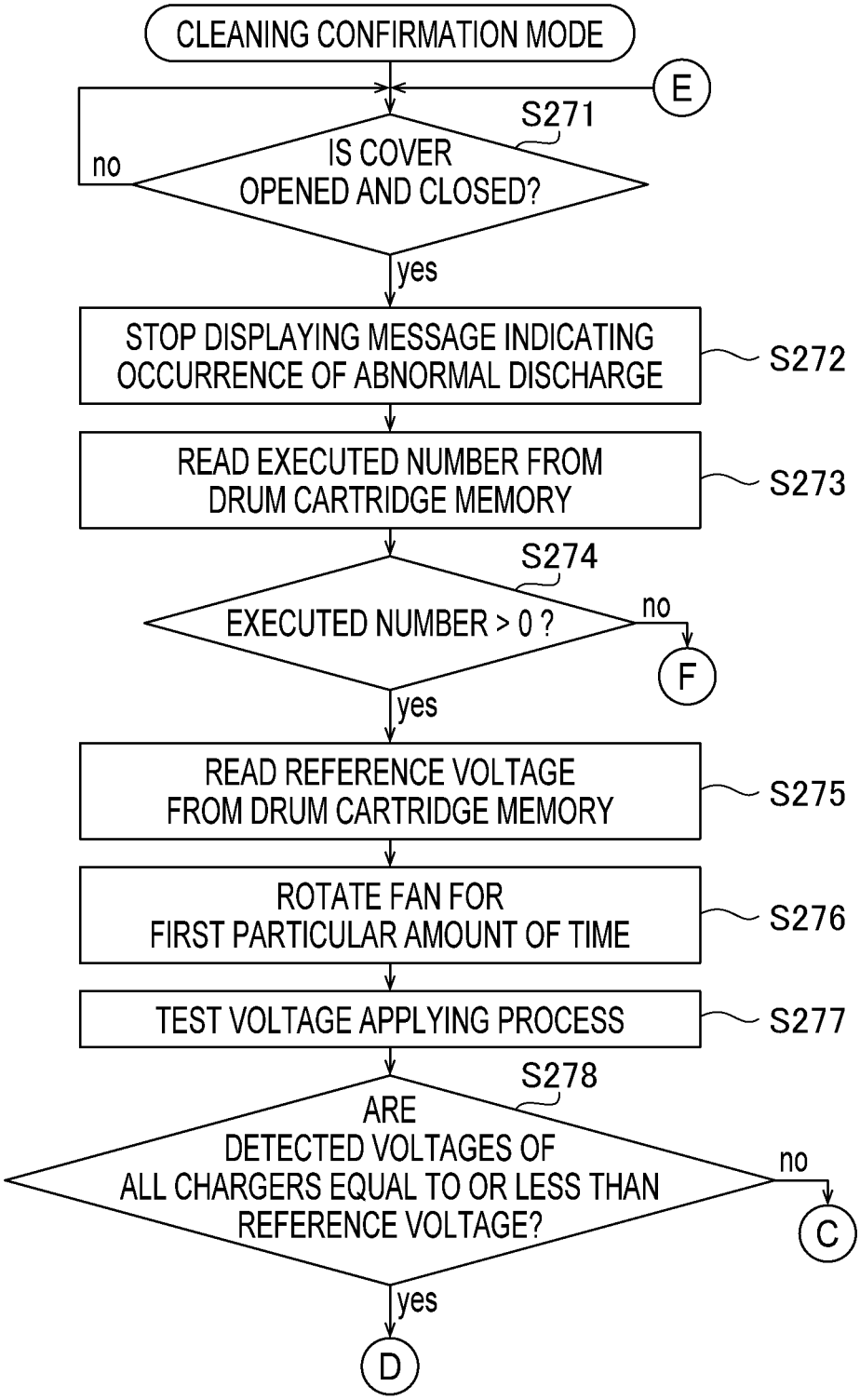
FIGS. 8 and 9 show a flowchart, according to the second embodiment, illustrating details of processes in the cleaning confirmation mode.
Figure 9:
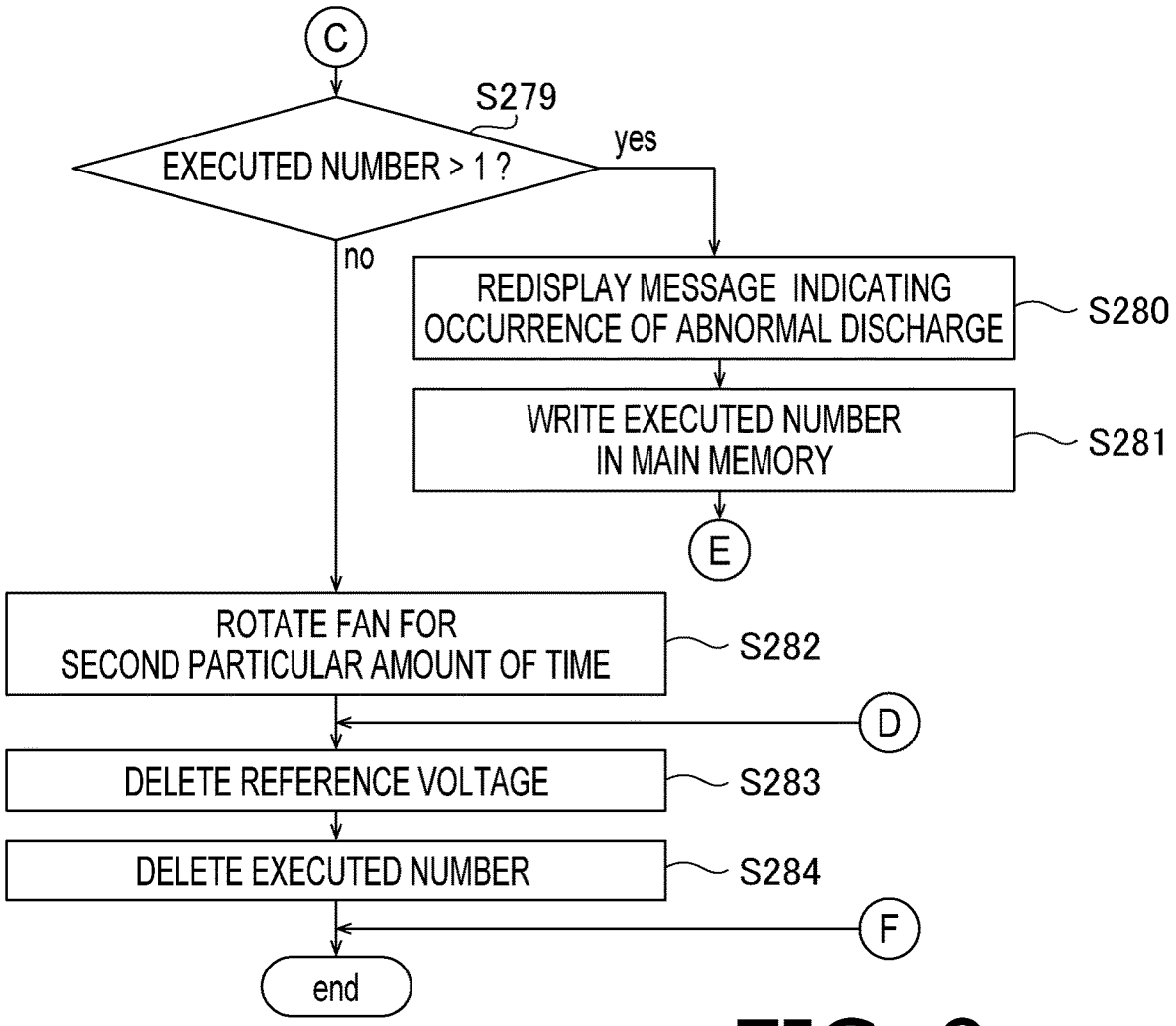

Hereinafter, a second embodiment of the present disclosures will be described with reference to FIGS. 7-9. In the second embodiment, the processor 81 executes a storing process, a calculating process, a writing process, a test voltage applying process, a voltage determination process, a deletion process, an error displaying process and a fan rotating process which will be described later.

<2-1. Processes Triggering Cleaning Confirmation Mode>

Processes that trigger the cleaning confirmation mode which will be described later will be described with reference to FIG. 7. FIG. 7 is a flowchart illustrating processes that trigger the cleaning confirmation mode.

Figure 7:
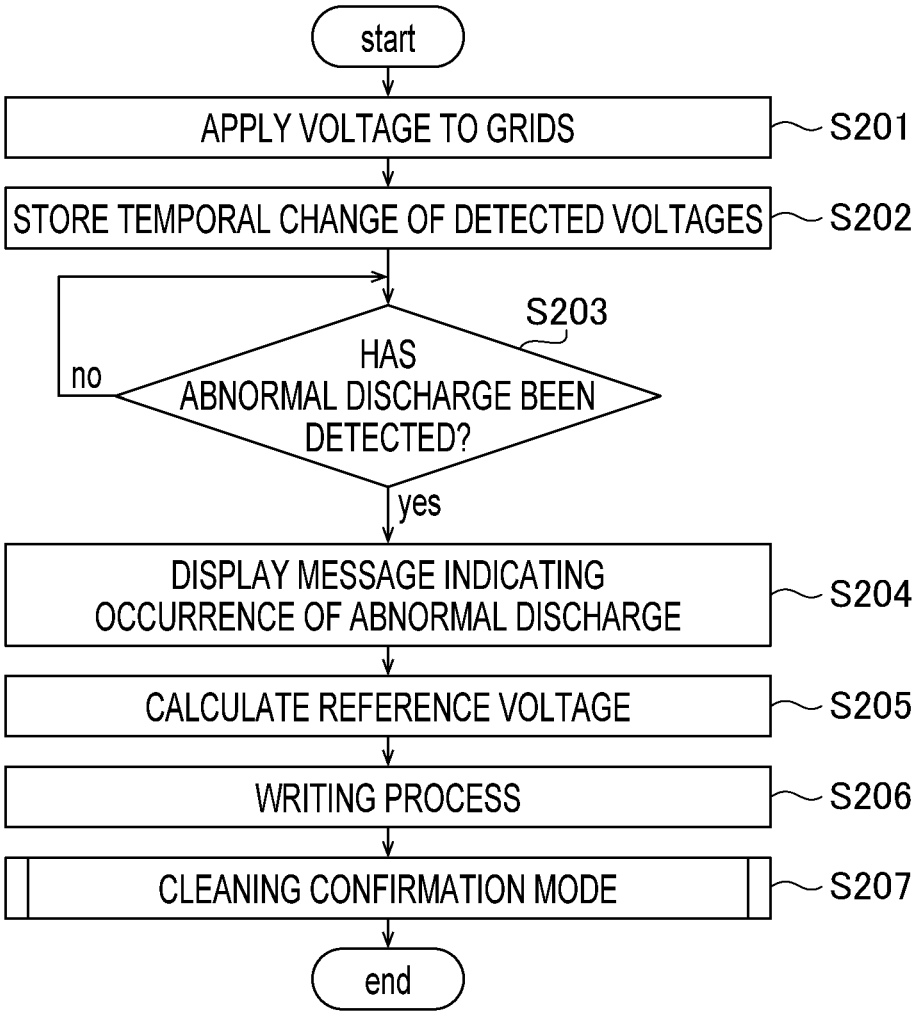
FIG. 7 is a flowchart, according to a second embodiment, illustrating processes that trigger a cleaning confirmation mode.

As shown in FIG. 7, the voltage applying circuit 83 applies an applying voltage to the wires and the grids of respective chargers 32 corresponding to respective colors (i.e., respective toner cartridges 20) (Step S201). While applying the applying voltage to the wires and the grids of the chargers using the voltage applying circuit 83, the controller 83 stores temporal changes of voltages detected at the wires of the chargers 32 in the main memory 82 (Step S202: storing process). At this time, the controller stores the temporal change of the voltage detected at the charger 32 for each color (i.e., for each toner cartridge). Specifically, the controller 80 stores the voltages detected at the wires of the chargers 32 in the main memory 82 at regular intervals (e.g., at 1 msec intervals).

Then, the abnormal discharge detection circuit 84 detects occurrence of the abnormal discharge based on a current value of current that flows through a transformer of the voltage applying circuit 83 (Step S203). Specifically, the abnormal discharge detection circuit 84 detects occurrence of the abnormal discharge in a case where current that is equal to or more than a threshold current value flows through the transformer of the voltage applying circuit 83 which is applying voltage on the wires and the grids. The controller 80 determines that the abnormal discharge occurred in a case where the abnormal discharge was detected in one or more colors (Step S203: YES). In a case where it is not determined that the abnormal discharge was detected in one or more colors (Step S203: NO), the controller 80 repeats Step S203.

In a case where it is determined that the abnormal discharge occurred (Step S203: YES), the controller 80 causes the display 90 to display a message indicating that the abnormal discharge occurred (Step S204: error displaying process). The message which the controller 80 causes the display 90 to display is a message that prompts a user to perform cleaning of the wires of the chargers 32 for all the four colors. The message which the controller 80 causes the display 90 to display may be a message that prompts a user to perform cleaning of one or more wires of one or more chargers 32 in which the abnormal discharge occurred.

Then, the controller 80 executes the calculating process (Step S205). In the calculating process, the controller 80 reads first detected voltages from the main memory 82. The first detected voltages are voltages that are detected at the wires of the chargers 32 just before the detection of the occurrence of the abnormal discharge by the abnormal discharge detection circuit 84. Specifically, the controller 80 reads the voltages that were detected at the wires of the chargers 32 a particular time period before the abnormal discharge detection circuit 84 detected the occurrence of the abnormal discharge as the first detected voltages. In the calculating process, the controller 80 further calculates, based on the first detected voltages, a reference voltage being lower than the first detected voltages. The reference voltage is a voltage that is to be used in the test voltage applying process which will be described later.

Then, the controller stores the reference voltage in the drum cartridge memory 33 (Step S206: writing process). In Step S206, the controller 80 further stores a preset value (e.g., three) in the drum cartridge memory 33 as an upper limit of an executed number, the executed number indicating a number of times the test voltage applying process which will be described later is executed. In Step S206, the controller 80 further reads the first detected voltages from the main memory 82 and stores in the drum cartridge memory 33. Then, the controller 80 executes the cleaning confirmation mode (Step S207).

<2-2. Processes in Cleaning Confirmation Mode>

Next, a flow of processes in the cleaning confirmation mode will be described. FIGS. 8 and 9 show a flowchart illustrating processes in the cleaning confirmation mode.

In the cleaning confirmation mode, the controller 80 firstly determines whether the sensor 87 detected the movement of the cover 12 from the open position to the closed position (Step S271). In a case where it is determined that the sensor 87 does not detect the movement of the cover 12 from the open position to the closed position (Step S271: NO), the controller 80 repeats the determination process of Step S271. On the other hand, in a case where it is determined that the sensor 87 detects the movement of the cover 12 from the open position to the closed position (Step S271: YES), the controller 80 causes the display 90 to stop displaying the message that is displayed at Step S204 (Step S272).

Then, the controller 80 reads the executed number from the drum cartridge memory 33 (Step S273). The controller 80 may execute Step S273 in a case where the sensor 87 detects the movement of the cover 12 from the open position to the closed position after the image forming apparatus 100 is switched on. Then, the controller 80 determines whether or not the executed number is greater than zero (Step S274). In a case where it is determined that the executed number is not greater than zero (Step S274: NO), the controller 80 terminates the cleaning confirmation mode.

On the other hand, in a case where it is determined that the executed number is greater than zero (Step S274: YES), the controller 80 reads the reference voltage from the drum cartridge memory 33 (Step S275) and causes the fan 40 to rotate for a first particular amount of time (Step S276). At least a portion of the air in the inner space of the main frame 11 is thereby drawn to outside.

After causing the fan 40 to rotate for the first particular amount of time, the controller 80 executes the test voltage applying process (Step S277). In the test voltage applying process, the controller 80 applies, to the wires and the grids of the chargers 32 using the voltage applying circuit 83, a voltage that is lower than the applying voltage that had been applied to the wires and the grids of the chargers 32 in a case where the abnormal discharge detection circuit 84 detects the occurrence of the abnormal discharge. The controller 80 executes the test voltage applying process for all the chargers (i.e., all the colors) of which the first detected voltages exceeds a particular value.

Then, the controller 80 determines whether detected voltages, detected at the wires of the chargers 32 in a case where the voltage applying circuit 83 applied the voltage that is lower than the applying voltage that is applied to the wires and the grids of the chargers 32 in a case where the abnormal discharge detection circuit 84 detected the occurrence of the abnormal discharge to the wires and the grids of the chargers 32, are equal to or lower than the reference voltage (Step S278: voltage determination process). Specifically, in the voltage determination process, the controller 80 determines whether or not the detected voltage is equal to or less than the reference voltage for all the chargers (i.e., all the colors) to which the test voltage applying process is executed.

In a case where it is determined in the voltage determination process that the detected voltages are equal to or less than the reference voltage (Step S278: YES), the controller 80 deletes the reference voltage from the drum cartridge memory 33 (Step S283: Deletion process). The controller 80 further deletes the executed number from the drum cartridge memory 33 (Step S284: deletion process). Then, the controller 80 terminates the cleaning confirmation mode.

On the other hand, in a case where it is determined in the voltage determination process that the detected voltages are higher than the reference voltage (Step S278: NO), the controller 80 executes a determination process at Step S279. In Step S279, the controller 80 determines whether or not the executed number is greater than 1.

In a case where it is determined that the executed number is not greater than 1 (Step S279: NO), the controller 84 causes the fan 40 to rotate for a second particular amount of time (Step S282). The second particular amount of time for causing the fan 40 to rotate is preferably longer than the first particular amount of time for causing the fan 40 to rotate at Step S276. Therefore, at least most of the air in the inner space of the main frame 11 is thereby drawn to outside.

After causing the fan 40 to rotate for the second particular amount of time, the controller 80 deletes the reference voltage from the drum cartridge memory 33 (Step S283:

deletion process). The controller 80 further deletes the executed number from the drum cartridge memory 33 (Step S284: deletion process). Then, the controller 80 terminates the cleaning confirmation mode.

On the other hand, in a case where it is determined that the executed number is greater than 1 (Step S279: YES), the controller 80 causes the display 90 to redisplay the message indicating that the abnormal discharge occurred (Step S280: error displaying process).

Then, the controller 80 decrements the executed number by one and writes the decremented executed number in the drum cartridge memory 33 (Step S281). The Step S281 may be a process of incrementing the executed number by one. That is, the controller 80 stores the executed number which is incremented or decremented by one in the drum cartridge memory 33. In a case where Step S281 is a process of incrementing the executed number by one, Steps S206, S274 and S279 described above may for example be modified as follows. In Step S206, the controller 80 may set the executed number to zero. In Step S274, the controller 80 may determine whether the executed number is less than the preset value. In Step S279, the controller 80 may determine whether the executed number is less than a value obtained by subtracting one from the preset value.

After Step S281, the controller 80 goes back to the determination process at Step S271.

<2-3. Summary of Second Embodiment>

As described above, the image forming apparatus 100 of the second embodiment includes the casing 10, the drum cartridge 30, the controller 80 and the main memory 82. The drum cartridge 30 includes the photosensitive drums 31, the chargers 32 and the drum cartridge memory 33. The controller 80 includes the abnormal discharge detection circuit 84 and the voltage applying circuit 83. The controller 80 executes the storing process (Step S202), the calculating process (Step S205), the writing process (Step S206), the test voltage applying process (Step S277), the determination process (Step S278) and the deletion process (Steps S283 and S284). By this configuration, even in a case where a drum cartridge 30 that was mounted and used in the casing 10 of an image forming apparatus 100 is mounted to the casing 10 of another image forming apparatus 100, it becomes possible for the drum cartridge 30 to store the executed number. Therefore, even in a case where a drum cartridge 30 that was mounted and used in the casing 10 of an image forming apparatus 100 is mounted to the casing 10 of another image forming apparatus 100, the controller 80 can determine whether the abnormal discharge has ever occurred in the drum cartridge 30 or whether the abnormal discharge state can be released by referring to the executed number.

Also, in the image forming apparatus 100 of the second embodiment, in a case where it is determined as a result of the test voltage applying process (Step S277) that the detected voltages detected at the wires of the chargers 32 are higher than the reference voltage (Step S278: NO), the controller 80 executes the error displaying process again (Step S280). By this configuration, it becomes possible to prompt a user to perform cleaning of the chargers 32 and presume whether or not the cleaning of the chargers 32 was performed correctly.

Also, in the image forming apparatus 100 of the second embodiment, in a case where it is determined as a result of the test voltage applying process (Step S277) that the detected voltages detected at the wires of the chargers 32 are higher than the reference voltage (Step S278: NO), the controller 80 increments or decrements the executed number and repeats the error displaying process (Step S280), the test voltage applying process (Step S277) and the determination process (Step S278) until it is determined in the determination process that the detected voltages detected at the wires of the chargers 32 are equal to or less than the reference voltage or until the executed number reaches the preset value. By this configuration, it becomes possible to prompt a user to perform cleaning of the chargers 32 and presume whether or not the cleaning of the chargers 32 was performed correctly.

The image forming apparatus 100 of the second embodiment includes the fan 40. The controller 80 executes the fan rotating process (Step S282) of rotating the fan 40 for the particular period of time in a case where the executed number reaches the preset value. By this configuration, in a case where it cannot be presumed that the cleaning is performed correctly although the test voltage applying process is repeated for the preset number of times (e.g., three times), the air in the image forming apparatus 100 can be drawn to outside by rotating the fan 40 for the particular period of time. Therefore, even in a case where a user cleaned the inside of the image forming apparatus 100 using flammable gas or the like, the flammable gas or the like can be drawn out of the image forming apparatus 100 by the fan 40.

<2-4. Variations of Second Embodiment>

The present disclosures are not limited to the above-described illustrative second embodiment.

The discharge history information may include pieces of information of all the abnormal discharges occurred in the past, or the controller 80 may delete old pieces of information of the abnormal discharges one by one.

In the above described second embodiment, the upper limit of the executed number (i.e., the preset value) has been described to be three. However, the upper limit of the executed number may be two or equal to or more than four.

Furthermore, elements appearing in the above described first and second embodiments and their variations may be appropriately combined provided the combination is consistent.

3. Third Embodiment

Figure 11:
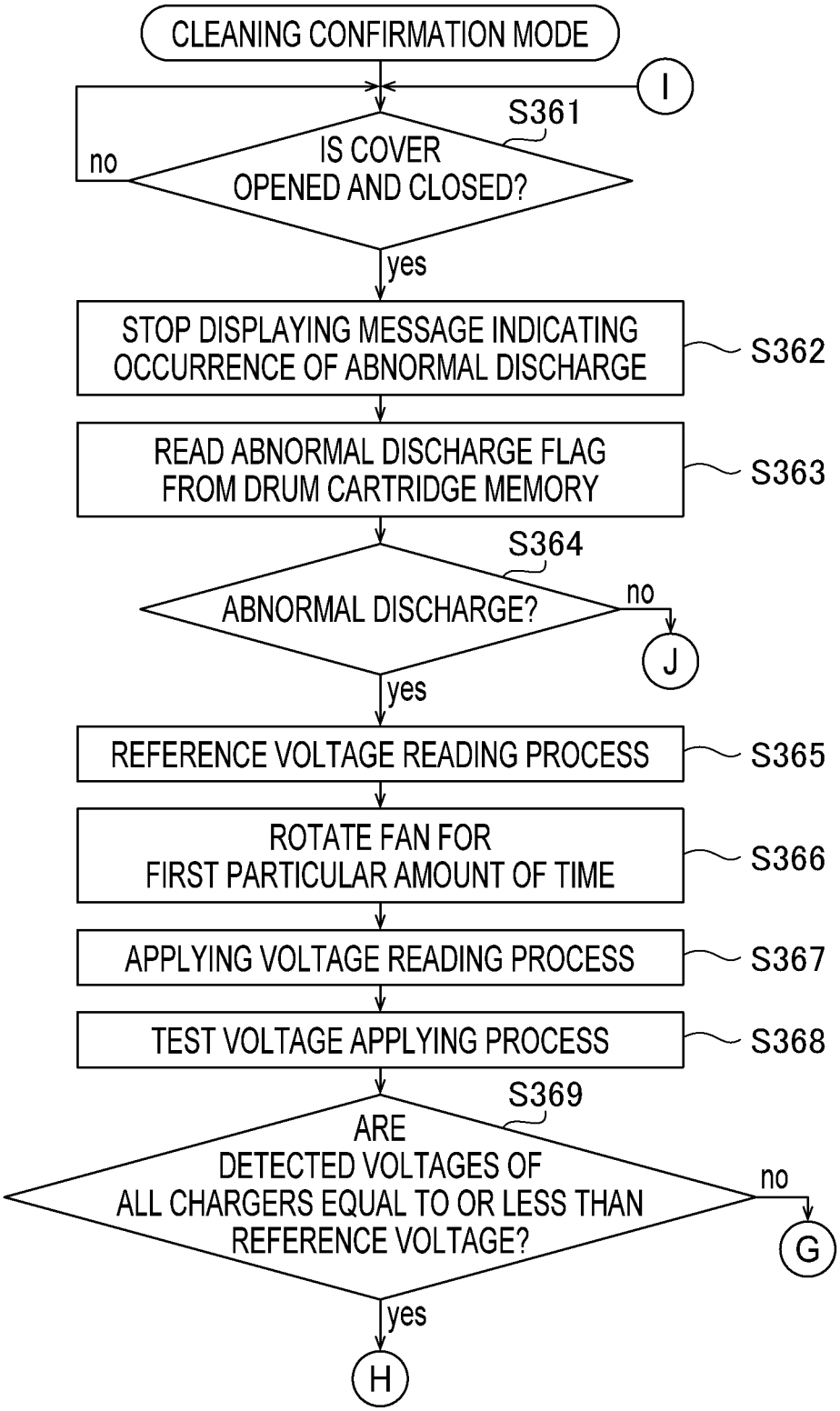
FIGS. 11 and 12 show a flowchart, according to the third embodiment, illustrating details of processes in the cleaning confirmation mode.
Figure 12:
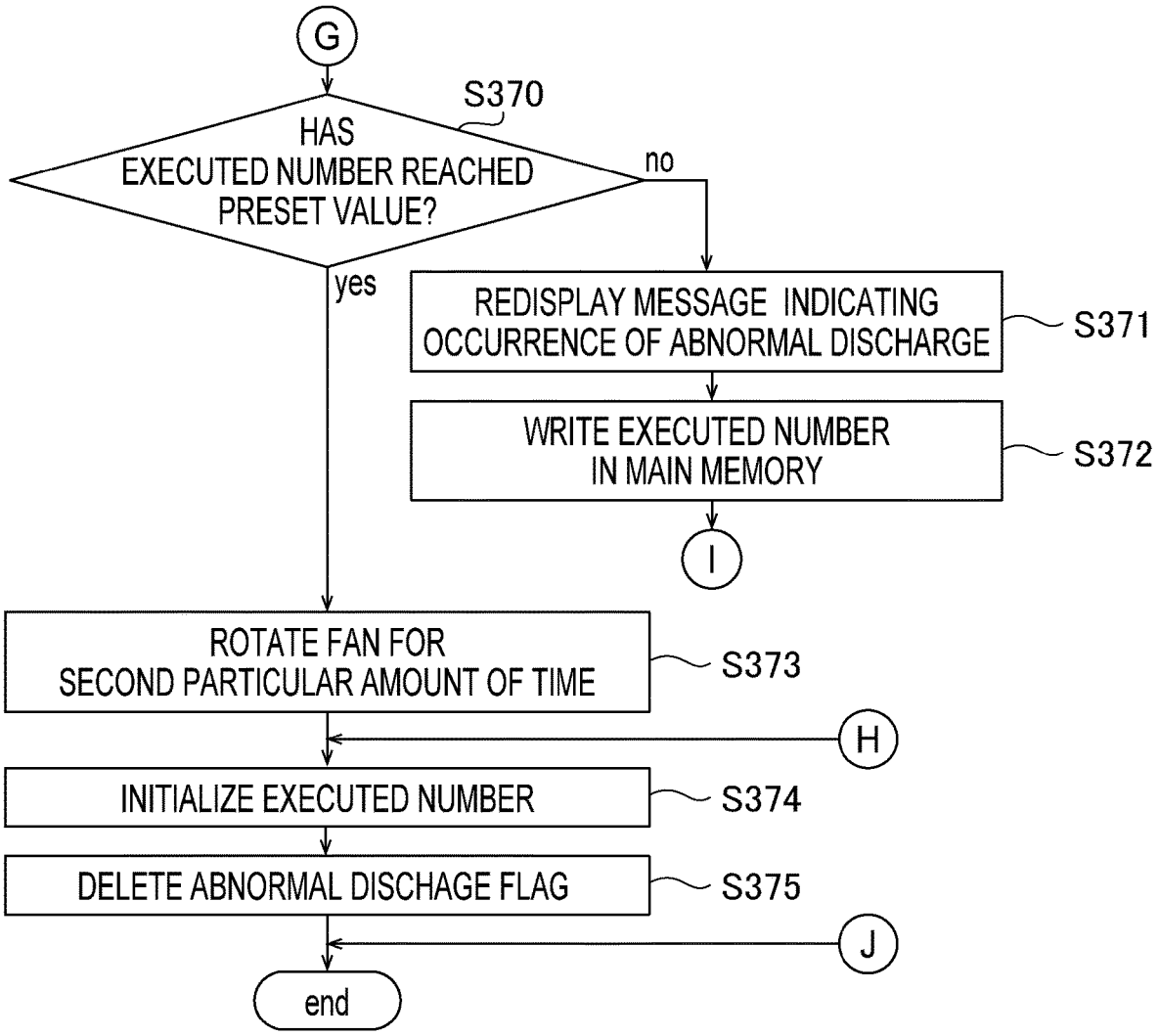

Hereinafter, a third embodiment of the present disclosures will be described with reference to FIGS. 10-12. In the third embodiment, the processor 81 executes an abnormal discharge flag generation process, a test voltage applying process, a voltage determination process, an abnormal discharge flag deletion process and an error displaying process which will be described later.

<3-1. Processes Triggering Cleaning Confirmation Mode>

Processes that trigger the cleaning confirmation mode which will be described later will be described with reference to FIG. 10. FIG. 10 is a flowchart illustrating processes that triggers the cleaning confirmation mode.

Figure 10:
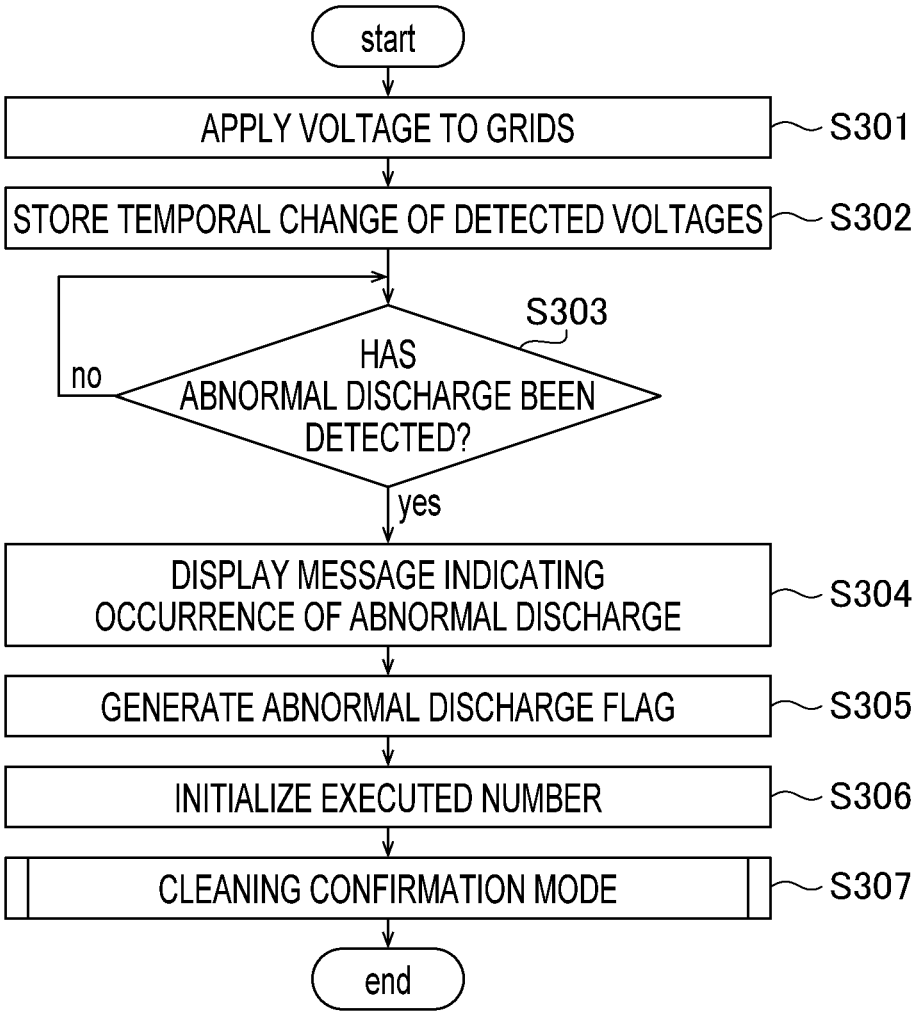
FIG. 10 is a flowchart, according to a third embodiment, illustrating processes that trigger a cleaning confirmation mode.

As shown in FIG. 10, the voltage applying circuit 83 applies an applying voltage to the wires and the grids of respective chargers 32 (Step S301). While applying the applying voltage to the wires and the grids of the chargers using the voltage applying circuit 83, the controller 83 stores temporal changes of voltages detected at the wires of the chargers 32 in the main memory 82 (Step S302: storing process). At this time, the controller stores the temporal change of the voltage detected at the charger 32 for each color (i.e., for each toner cartridge). Specifically, the controller 80 stores the voltages detected at the wires of the chargers 32 in the main memory 82 at regular intervals (e.g., at 1 msec intervals).

Then, the abnormal discharge detection circuit 84 detects occurrence of the abnormal discharge based on a current value of current that flows through a transformer of the voltage applying circuit 83 (Step S303). Specifically, the abnormal discharge detection circuit 84 detects occurrence of the abnormal discharge when current that is equal to or more than a threshold current value flows through the transformer of the voltage applying circuit 83 which is applying voltage on the wires and the grids. The controller 80 determines that the abnormal discharge occurred in a case where the abnormal discharge was detected in one or more colors (Step S303: YES). In a case where no abnormal discharge was detected in any colors (Step S303: NO), the controller 80 repeats Step S303.

In a case where it is determined that the abnormal discharge occurred (Step S303: YES), the controller 80 causes the display 90 to display a message indicating that the abnormal discharge occurred (Step S304: error displaying process). The message which the controller 80 causes the display 90 to display is a message that prompts a user to perform cleaning of the wires of the chargers 32 for all the four colors. The message which the controller 80 causes the display 90 to display may be a message that prompts a user to perform cleaning of one or more wires of one or more chargers 32 in which the abnormal discharge occurred. Then, the controller generates an abnormal discharge flag and stores the generated abnormal discharge flag in the drum cartridge memory 33 (Step S305: abnormal discharge flag generation process).

Then, the controller 80 initializes an executed number stored in the drum cartridge memory 33 to a default value (Step S306). The executed number is a value that indicates the number of times the test voltage applying process is executed. In the third embodiment, as will be described later, the executed number is incremented each time the test voltage applying process is executed, and the number of times the test voltage applying process was executed is monitored by determining whether or not the executed number reached a preset value. Therefore, in the third embodiment the default value is one. Then, the controller 80 executes the cleaning confirmation mode (Step S307).

<3-2. Processes in Cleaning Confirmation Mode>

Next, a flow of processes in the cleaning confirmation mode will be described. FIGS. 11 and 12 show a flowchart illustrating processes in the cleaning confirmation mode.

In the cleaning confirmation mode, the controller 80 firstly determines whether the sensor 87 detects the movement of the cover 12 from the open position to the closed position (Step S361). In a case where it is determined that the sensor 87 does not detect the movement of the cover 12 from the open position to the closed position (Step S361: NO), the controller 80 repeats the determination process of Step S361. On the other hand, in a case where it is determined that the sensor 87 detected the movement of the cover 12 from the open position to the closed position (Step S371: YES), the controller 80 causes the display 90 to stop displaying the message that was displayed at Step S304 (Step S362). Then, the controller 80 reads the abnormal discharge flag from the drum cartridge memory 33 (Step S363).

The controller 80 may execute Step S363 in a case where, after the image forming apparatus 100 is switched on, the controller 80 initializes the executed number stored in the drum cartridge memory 33 to the default value and the sensor 87 detects the movement of the cover 12 from the open position to the closed position.

Then, the controller 80 determines whether or not the abnormal discharge flag indicates that the abnormal discharge occurred (Step S364). In a case where it is determined that the abnormal discharge flag does not indicate that the abnormal discharge occurred (Step S364: NO), the controller 80 terminates the cleaning confirmation mode.

On the other hand, in a case where it is determined that the abnormal discharge flag indicates that the abnormal discharge occurred (Step S364: YES), the controller 80 reads a reference voltage from the main memory 82 (Step S365). The reference voltage is a voltage that is to be used in the test voltage applying process which will be described later. The reference voltage is lower than voltages that are detected at the chargers 32 when charging the outer peripheries of the photosensitive drum 31 using the chargers 32, and is stored in the main memory 82.

After reading the reference voltage, the controller 80 causes the fan 40 to rotate for a first particular amount of time (Step S366). After causing the fan 40 to rotate for the first particular amount of time, the controller 80 executes a test voltage reading process (Step S367). In the test voltage reading process, the controller 80 reads the test voltage to be used in the test voltage applying process which will be described later from the main memory 82. The test voltage is lower than the voltages to be applied to the wires and the grids of the chargers 32 when charging the outer peripheries of the photosensitive drum 31 using the chargers 32, and is stored in the main memory 82.

After reading the test voltage from the main memory 82, the controller 80 executes the test voltage applying process (Step S368). In the test voltage applying process, the controller 80 applies the test voltage to the grids of the chargers 32 using the voltage applying circuit 83. The controller executes the test voltage applying process for all the colors (i.e., all the chargers 32) in which the abnormal discharge occurred.

Then, the controller 80 determines whether detected voltages being detected at the wires of the chargers 32 in a case where the test voltage is applied to the grids of the chargers are equal to or less than the reference voltage (Step S369: voltage determination process). The controller 80 determines whether the detected voltage is equal to or less than the reference voltage for all the colors for which the test voltage applying process is executed.

Then, in a case where it is determined in the voltage determination process that the detected voltages detected at the wires of the chargers 32 are equal to or less than the reference voltage (Step S369: YES), the controller 80 initializes the executed number stored in the drum cartridge memory 33 to the default value (Step S374). The controller 80 further deletes the abnormal discharge flag stored in the drum cartridge memory 33 (Step S375). Upon deleting the abnormal discharge flag, the controller 80 terminates the cleaning confirmation mode.

On the other hand, in a case where it is determined in the voltage determination process that the detected voltages being detected at the wires of the chargers 32 are higher than the reference voltage (Step S369: NO), the controller 80 executes a determination process at Step S370. At Step S370, the controller 80 determines whether the executed number reaches a preset value (e.g., three) being set in advance as an upper limit of the number of times to execute the test voltage applying process. The executed number is a value that indicates the number of times the test voltage applying process is executed and is incremented at Step S372 which will be described later each time the test voltage applying process is executed.

In a case where it is determined that the executed number reaches the preset value (Step S370: YES), the controller 80 causes the fan 40 to rotate for a second particular amount of time (Step S373). The second particular amount of time for causing the fan 40 to rotate is preferably longer than the first particular amount of time for causing the fan 40 to rotate at Step S363. Therefore, at least most of the air in the inner space of the main frame 11 is thereby drawn to outside.

After causing the fan 40 to rotate for the second particular amount of time, the controller 80 initializes the executed number stored in the drum cartridge memory 33 to the default value (Step S374). The controller further deletes the abnormal discharge flag stored in the drum cartridge memory 33 (Step S375). Upon deleting the abnormal discharge flag, the controller 80 terminates the cleaning confirmation mode.

On the other hand, in a case where it is determined that the executed number does not reach the preset value (Step S370: NO), the controller 80 causes the display 90 to redisplay the message indicating that the abnormal discharge occurred (Step S371: error displaying process).

Then, the controller 80 increments the executed number and stores the incremented executed number in the drum cartridge memory 33 (Step S372).

After Step S372, the controller 80 goes back to the determination process at Step S361.

<3-4. Summary of Third Embodiment>

As described above, the image forming apparatus 100 of the third embodiment includes the casing 10, the drum cartridge 30, the main memory 82 and the controller 80. The drum cartridge 30 includes the photosensitive drums 31, the chargers 32 and the drum cartridge memory 33. The controller 80 executes the abnormal discharge flag generation process (Step S305), the test voltage applying process (Step S368), the voltage determination process (Step S369) and the abnormal discharge flag deletion process (Step S375). By this configuration, even in a case where a drum cartridge 30 that was mounted and used in the casing 10 of an image forming apparatus 100 is mounted to the casing 10 of another image forming apparatus 100, it becomes possible for the drum cartridge 30 to store the abnormal discharge flag. Therefore, even in a case where a drum cartridge 30 that was mounted and used in the casing 10 of an image forming apparatus 100 is mounted to the casing 10 of another image forming apparatus 100, the controller 80 can determine whether the abnormal discharge has ever occurred in the drum cartridge 30 or whether the abnormal discharge state can be released by referring to the abnormal discharge flag.

Also, in the image forming apparatus 100 of the third embodiment, the main memory 82 stores the reference voltage which is lower than the voltages that are detected at the chargers 32 when charging the outer peripheries of the photosensitive drum 31 using the chargers 32. Therefore, it is not necessary to calculate the reference voltage each time the abnormal discharge is detected. Accordingly, it is possible to reduce load on the controller 80.

Also, in the image forming apparatus 100 of the third embodiment, if it is not determined that the detected voltages being detected at the chargers 32 in a case where the test voltage is applied to the chargers 32 are equal to or less than the reference voltage, the controller 80 repeats the process of determining whether the detected voltages being detected at the chargers 32 in a case where the test voltage is applied to the chargers 32 are equal to or less than the reference voltage until the executed number reaches the preset value. By this configuration, it becomes possible to repeat the process of presuming whether or not the cleaning of the chargers 32 was performed correctly.

The image forming apparatus 100 of the third embodiment further includes the fan 40. The controller 80 causes the fan 40 to rotate for the particular period of time if the executed number reached the preset value. By this configuration, the air in the image forming apparatus 100 can be drawn to outside by rotating the fan 40 for the particular period of time in a case where it cannot be presumed that the cleaning is performed correctly although the test voltage applying process was repeated for the preset number of times. Therefore, even in a case where a user cleaned the inside of the image forming apparatus 100 using flammable gas or the like, the flammable gas or the like can be drawn out of the image forming apparatus 100 by the fan 40.

The image forming apparatus 100 of the third embodiment further includes the display 90. In a case where the occurrence of the abnormal discharge is detected, the controller 80 further executes the error displaying process of causing the display 90 to display the error message. By this configuration, it becomes possible to prompt a user to perform cleaning of the chargers 32 in a case where the abnormal discharge occurred.

<3-4. Variations of Third Embodiment>

The present disclosures are not limited to the above-described illustrative third embodiment.

In the above described third embodiment, the executed number is incremented at Step S372 each time the test voltage applying process is executed. However, the executed number may be decremented. In a case where the executed number is to be decremented, for example, the default value in the above-described third embodiment should be set to the preset value and it should be determined in Step S370 whether or not the executed number is greater than one.

The discharge history information may include pieces of information of all the abnormal discharges occurred in the past, or the controller 80 may delete old pieces of information of the abnormal discharges one by one.

In the above described second embodiment, the upper limit of the executed number (i.e., the preset value) has been described to be three. However, the upper limit of the executed number may be two or equal to or more than four.

Furthermore, elements appearing in the above described first to third embodiments and their variations may be appropriately combined provided the combination is consistent.

What is claimed is:

1. An image forming apparatus comprising:

a toner cartridge accommodating toner;

a drum cartridge for use with the toner cartridge, the drum cartridge comprising a photosensitive drum, and a drum memory storing a life count value representing at least one of a cumulative number of rotations of the photosensitive drum, a cumulative number of sheets printed using the photosensitive drum, and a cumulative number of dots printed using the photosensitive drum, the drum memory being further configured to store history information relating to an abnormal state of the drum cartridge, the history information being different from the life count value; and a controller configured such that when the controller detects an occurrence of an error relating to the abnormal state of the drum cartridge, the controller writes on the drum memory information indicating that the error relating to the abnormal state occurred, wherein use of the drum cartridge is not permitted in response to determining that the history information relating to the abnormal state of the drum cartridge is stored in the drum memory and determining life of the drum based on the life count value.

2. The image forming apparatus according to claim 1, wherein use of the drum cartridge is not permitted in response to determining that the history information relating to the abnormal state of the drum cartridge is stored in the drum memory after the life count value is equal to or more than a threshold value.

3. The image forming apparatus according to claim 1, wherein use of the drum cartridge is not permitted in response to determining that the history information relating to the abnormal state of the drum cartridge is stored in the drum memory after the life count value is equal to or more than life of the drum cartridge.

4. The image forming apparatus according to claim 1, wherein the toner cartridge includes a developing roller.

5. The image forming apparatus according to claim 1, wherein a request of drum cartridge replacement is to be displayed in response to determining that the history information relating to the abnormal state of the drum cartridge is stored in the drum memory.

6. The image forming apparatus according to claim 5, wherein the request of drum cartridge replacement is to be displayed in response to determining that the history information relating to the abnormal state of the drum cartridge is stored in the drum memory after the life count value is equal to or more than a threshold value.

7. The image forming apparatus according to claim 5, wherein the request of drum cartridge replacement is to be displayed in response to determining that the history information relating to the abnormal state of the drum cartridge is stored in the drum memory after the life count value is equal to or more than life of the drum cartridge.

8. The image forming apparatus according to claim 5, wherein the toner cartridge includes a developing roller.

9. The image forming apparatus according to claim 1, further comprising a charger configured to charge an outer periphery of the photosensitive drum, wherein the history information relates to the abnormal state of the charger.

10. The image forming apparatus according to claim 5, further comprising a charger configured to charge an outer periphery of the photosensitive drum, wherein the history information relates to the abnormal state of the charger.

11. The image forming apparatus according to claim 9, wherein the abnormal state is an abnormal discharge of the charger.

12. The image forming apparatus according to claim 1, further comprising:

a main frame; and a fan rotatable such that the fan draws out air located within an inner space of the main frame.

13. The image forming apparatus according to claim 12, wherein the controller is configured such that when the controller detects the occurrence of the error relating to the abnormal state of the drum cartridge, the controller causes the fan to rotate.

* * * * *